US005462598A

United States Patent [19]

Servant et al.

[11] Patent Number: 5,462,598

[45] Date of Patent: Oct. 31, 1995

[54] CURTAIN COATING DEVICE

[75] Inventors: Jeanne D. Servant; Jean-Marie Baumlin, both of Chalon-sur-Saone, France

[73] Assignee: Eastman Kodak Company, Rochester, N.Y.

[21] Appl. No.: 94,102

[22] PCT Filed: Dec. 3, 1992

[86] PCT No.: PCT/EP92/02801

§ 371 Date: Jul. 28, 1993

§ 102(e) Date: Jul. 28, 1993

[87] PCT Pub. No.: WO93/11879

PCT Pub. Date: Jun. 24, 1993

[30] Foreign Application Priority Data

Dec. 10, 1991 [FR] France ..... 91 15562

[51] Int. Cl.[6] ..... B05C 5/00

[52] U.S. Cl. ..... 118/324; 118/325; 118/DIG. 4

[58] Field of Search ..... 118/DIG. 4, 324, 118/325, 255; 427/420

[56] References Cited

U.S. PATENT DOCUMENTS

| | | | |
|---|---|---|---|
| 3,867,901 | 2/1975 | Greiller | 118/50 |
| 4,109,611 | 8/1978 | Fahrni et al. | 118/325 |
| 4,222,343 | 9/1980 | Zimmerman et al. | 118/325 |
| 4,328,414 | 5/1982 | Atalia | 235/380 |
| 4,443,504 | 4/1984 | Burket et al. | 427/445 |
| 4,569,863 | 2/1986 | Koepke et al. | 427/414 |

FOREIGN PATENT DOCUMENTS

| | | |
|---|---|---|
| 0168986 | 1/1986 | European Pat. Off. . |
| 107818 | 4/1990 | European Pat. Off. . |

OTHER PUBLICATIONS

Stephan F. Kistler, "The Fluid Mechanics of Curtain Coating and Related Viscous Free Surface Flows With Contact Lines", Nov. 1983.

D. A. Dittman et al, Research Disclosure No. 14715, *Curtain Coating Apparatus,* Jul. 1976.

*Primary Examiner*—James C. Housel
*Assistant Examiner*—Rachel Heather Freed
*Attorney, Agent, or Firm*—Carl F. Ruoff

[57] ABSTRACT

The present invention relates to a device for coating a moving support by means of a curtain. According to the present invention, the lip of the coating device has a front surface 10 which is substantially vertical or positive, a positive rear surface 11 defining, with respect to the front surface 10, an angle of less than 90° and a chamfer 12 between the lower ends of the said front and rear surfaces, the said device being characterised in that the ratio between the thickness of the coating composition at the level of the front surface 10 of the lip and the width of the chamfer 12 is at least one.

15 Claims, 4 Drawing Sheets

CURTAIN COATING DEVICE

FIELD OF THE INVENTION

The invention relates to a coating device of the curtain type and finds application in particular in the coating of photographic film supports.

BACKGROUND OF THE INVENTION

FIG. 1, to which reference is now made, illustrates an embodiment of a conventional curtain coating machine as described for example in European Patent 107 818. In the following, the surfaces of the lip body, which will be discussed in more detail later, and the other surfaces of the coating device, are described with reference to the plane of the curtain. The front face of the coating device, that is to say the surface of the lip over which the coating product flows before leaving the coating device will be assumed to be positioned to the left of the observer.

The surfaces of the coating device are assumed to be portions of planes determined by a rotation in a clockwise direction, or in the opposite direction, with respect to the plane of the curtain itself. The positive angles correspond to rotations in a clockwise direction; the negative angles correspond to rotations in an anti-clockwise direction. The positive surfaces indicate surfaces whose angle of rotation is positive; the negative surfaces indicate surfaces whose angle of rotation is negative. As mentioned above, the front face designates in a general sense the surfaces over which the coating product flows before leaving the coating device, whilst the rear face designates the surfaces over which the coating product is deemed not to flow.

According to the embodiment shown in FIG. 1, a conventional curtain coating device comprises a feeding system from which flows a coating composition comprising at least one layer.

The feeding system shown comprises two slots 2, 3 from which two layers flow, superimposed on a slightly inclined flow surface 4. The device also comprises a lip 5 from which the coating composition leaves the device along a negative front surface 6, forming a curtain. The curtain then flows onto a moving support (not shown), which is driven for example by means of a suitable cylinder. The said lip comprises in addition a rear surface 7, which is negative, at least at its lower part, and a chamfer 8 between the bottom ends of the said front and rear surfaces, the chamfer 8 also defining a negative surface. FIG. 2 shows the lip 5 in more detail. In this example the front face of the lip forms a curve of radius R=48 mm; the angle $\alpha$ defined by the lower part of the rear surface of the lip with respect to the vertical is 15°; the angle $\beta$ formed by the chamfer with respect to the horizontal is 15°; the angle $\gamma$ formed by the tangent at the chamfer on the front face of the lip with respect to the vertical is 40°, all these angles being given in absolute values. In reality, according to this patent EP 107 818, the rear face of the lip defines a negative surface, as do the front surface 9 and the chamfer 8, the angles $\alpha$, $\beta$, $\gamma$ being negative with respect to the plane of the curtain. The main problem resulting from such a design lies in the fact that it is not suitable for high flow rates of coating composition. The flow rates suggested in this patent vary in fact between 1 and 1.17 cm3/cm/s, which for some applications may prove insufficient. In reality, with higher flow rates, when the negative angle $\gamma$ defined by the front surface 9 with respect to the vertical is relatively large, that is to say greater than 10° (and all the more so 40°, as suggested in the patent EP 107 818), such a design accentuates the defect in the curtain which is commonly referred to as "curtain bendback". Such a phenomenon describes the fact that the curtain, in general, does not fall vertically from the line of the chamfer where it leaves the lip. In reality, even if the lower end of the lip body is vertical, the curtain formed by the coating composition leaves the lip at a certain angle with respect to the vertical. This angle is referred to as the curtain bendback angle. From the lip to the support to which the coating composition is applied, the path of the curtain may be likened to a parabola, as with any object in free fall. This phenomenon is illustrated in FIG. 3. In the following the curtain bendback will be quantified by the distance between the curtain and the vertical plane passing through the end of the lip, measured at 9 cm from the said end. Table I below illustrates the bendback or deviation BB of the curtain obtained for an angle $\gamma$ of −15° as a function of the flow rate for two different values of viscosity, the angle $\beta$ formed by the chamfer with respect to the horizontal being 30°. The length of the chamfer is 1.34 mm. The liquids are mixtures of water, gelatin and surfactants at 40° C. The surface tension is 26 mN/m.

| VISCOSITY (P) | FLOW RATE ($cm^3/cm/s$) | BB (mm) |
|---|---|---|
| 0.04 | 1 | 0 |
| 0.04 | 2.2 | 17 |
| 0.04 | 4.6 | 34 |
| 0.04 | 6.4 | 33 |
| 0.77 | 1 | 0 |
| 0.77 | 2.2 | 0 |
| 0.77 | 4.6 | 12 |
| 0.77 | 6.4 | 19 |

For the two viscosity values it is clear that the curtain bendback increases considerably with the flow rate, particularly for low viscosity values. Such a phenomenon is highly detrimental from the point of view of the quality of the curtain and consequently the quality of the coating obtained, and considerably increases the complexity of the coating process. This curtain bendback in fact makes it difficult to accurately predict the point of impact of the curtain on the support to be coated. Consequently, tricky adjustments have to be made in the positioning of the coating device so as to take account of this deviation of the curtain. In addition, this bendback tends to bring the curtain significantly closer to the frame of the coating device. This means that sufficient space has to be provided in order to avoid the curtain hitting the frame of the coating device. For this purpose, it is necessary to extend the slightly inclined flow surface (4; FIG. 1). This is not desirable because of the instability appearing on this surface, this instability being all the greater, the larger the flow surface. Finally, if the edge rods, arranged on each side of the curtain in the plane of the said curtain so as to guide the edges of the curtain, do not have a suitable shape at the level of the lip of the coating device, a large standing wave will appear in the curtain, which will cause a streak in the coating. The greater the curtain bendback, the larger the standing wave will be.

Another problem which the present invention proposes to resolve is related to the wetting of the rear surface of the lip. As shown in FIG. 3, the coating compound climbs up the rear surface of the lip over a distance referenced WL. This wetting of the rear surface of the lip may cause non-uniform coating exhibiting, for example, streaks. For these reasons it is necessary for the wetting height WL to be as small as possible.

U.S. Pat. No. 4,109,611 recommends the use of a chamfer with a relatively large width, that is to say which may be as much as 2.5 mm. Such an approach also generates a large bendback in the curtain when the latter leaves the lip. In fact, since the width of the chamfer is large compared with the thickness of the liquid layer, the result is that the path of the liquid will be considerably deviated. This deviation will be accentuated by the fact that the liquid leaves the end of the lip with a horizontal velocity component in the direction of the natural deviation of the liquid. The greater the forces of inertia, the greater this effect.

Thus one of the objects of the present invention is to provide a curtain coating device in which the curtain bendback is reduced significantly compared with the devices of the prior art.

Another object of the present invention is to provide a coating device substantially reducing the wetting of the rear surface of the lip.

Other objects of the present invention will become apparent during the following detailed description.

SUMMARY OF THE INVENTION

The objects of the present invention are achieved by means of an improved coating device of the curtain type comprising a feeding device to supply a coating composition in the form of at least one layer, a flow surface over which the coating composition flows by gravity and a lip from which the composition leaves the coating device along a substantially vertical or positive front surface, the said lip comprising in addition a positive rear surface defining an angle of less than 90° with respect to the front surface, and a chamfer between the lower ends of the said front and rear surfaces, the said device being characterised in that the ratio between the thickness of the coating composition at the front surface of the lip and the width of the chamfer is at least one.

Advantageously, the said ratio is at least 5 and preferably at least 10. According to an advantageous embodiment of the present invention, the said front surface of the lip defines a maximum angle of ±10° with respect to the vertical.

According to another characteristic of the invention, the rear surface defines an angle of not more than 45° with respect to the front surface of the said lip. Preferably this angle is approximately 30°.

BRIEF DESCRIPTION OF THE DRAWINGS

In the following detailed description, reference will be made to the drawing in which.

DETAILED DESCRIPTION OF THE INVENTION

Figure 1:
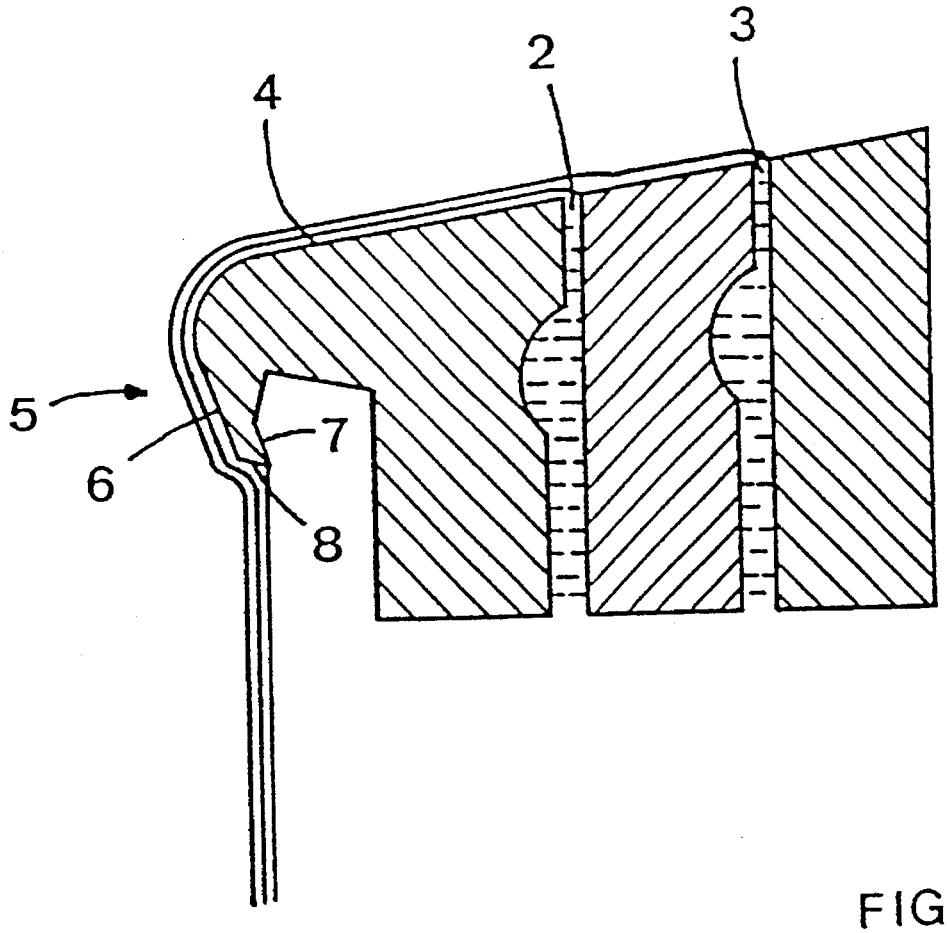
FIG. 1 PRIOR ART
FIG. 1 shows a coating device as described in the patent EP 107 818.
Figure 2:
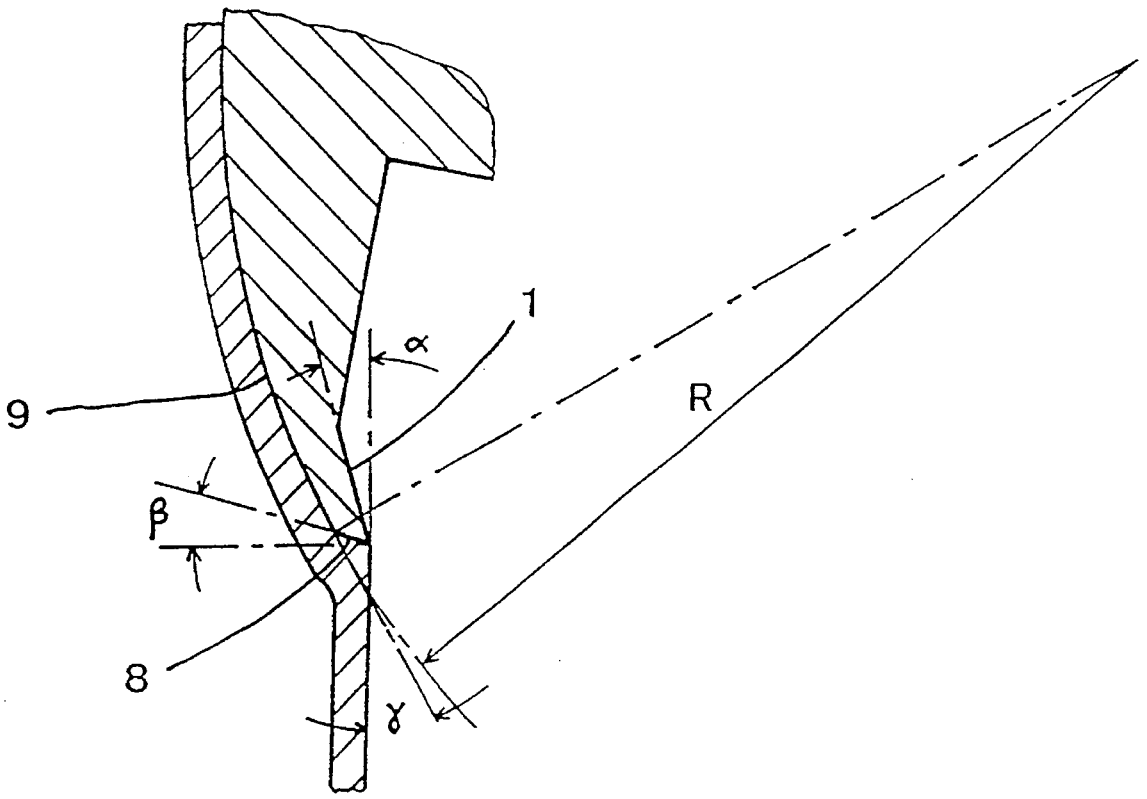
FIG. 2 PRIOR ART
FIG. 2 shows in detail the lip of the coating device of FIG. 1.
Figure 3:
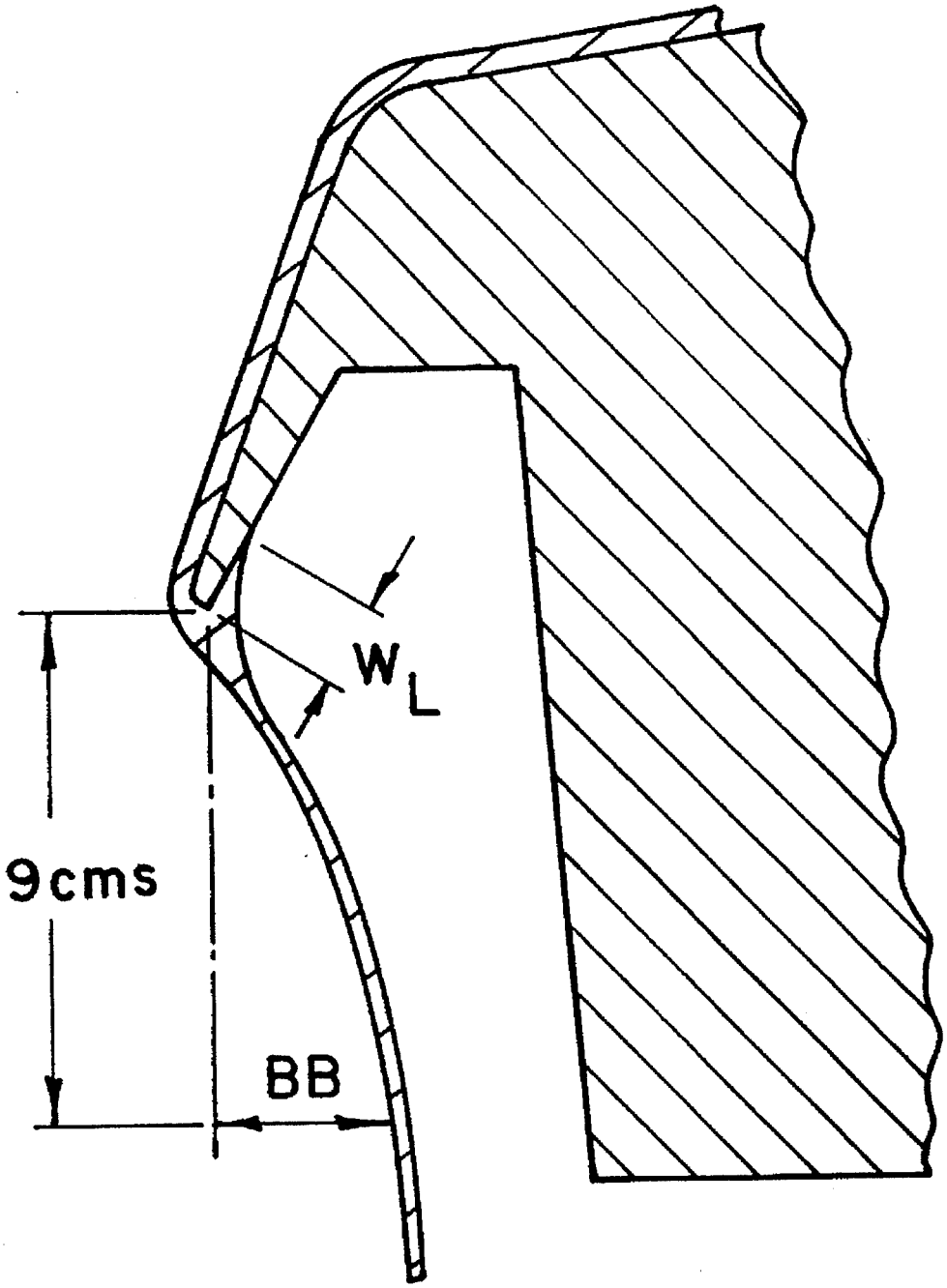
FIG. 3 illustrates diagrammatically the phenomena of curtain bendback (or deviation of the curtain) and wetting of the rear surface of the lip, discussed in the first part of the description.
Figure 4:
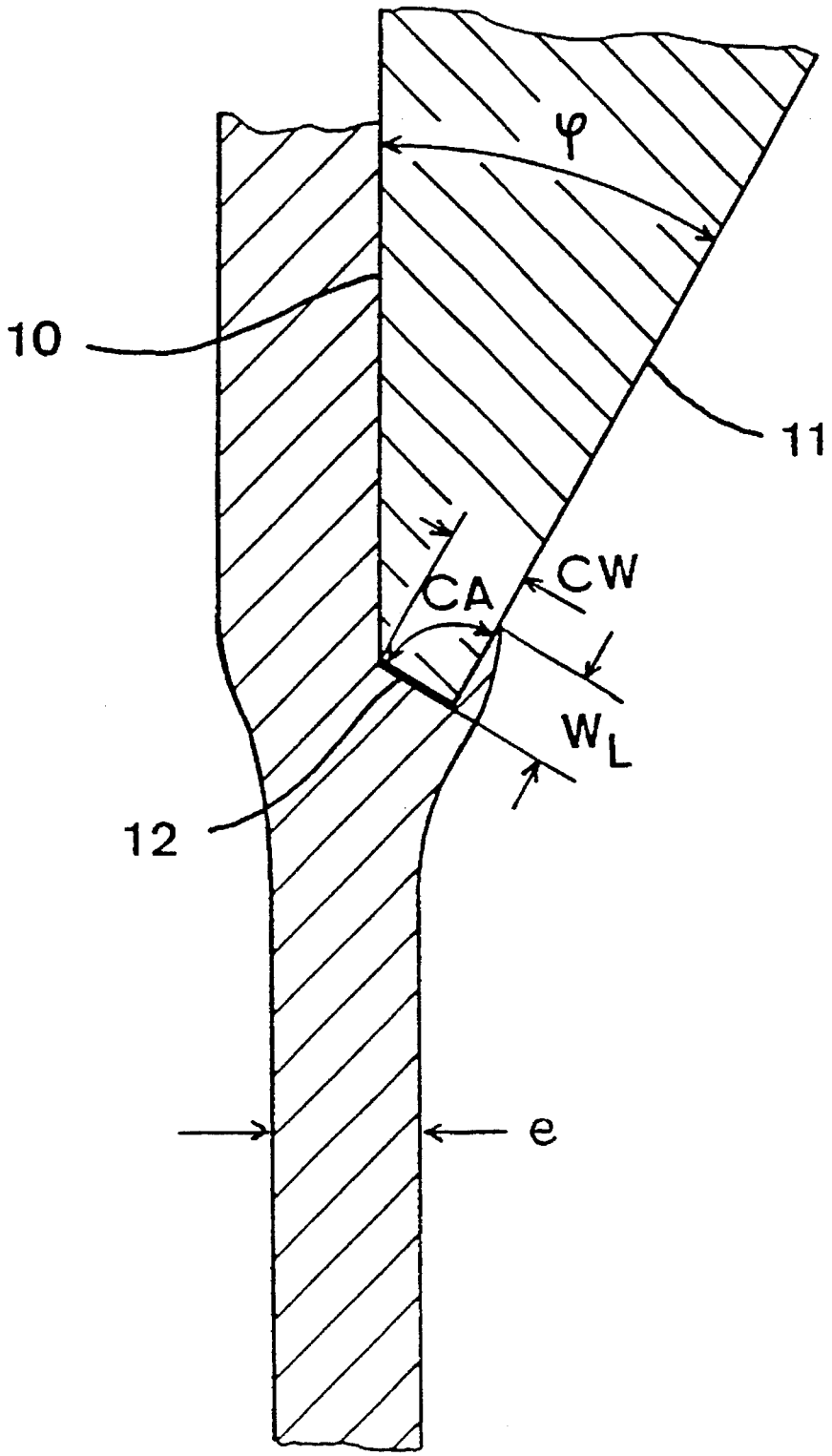
FIG. 4 shows diagrammatically the lip of the coating device according to the present invention.

FIG. 4, to which reference is now made, illustrates diagrammatically an embodiment of the lip of the coating device according to the present invention, the other parts of the coating device being similar to those described with reference to the patent EP 107 818, these requiring no further detailed description. Such is the case with the feeding device enabling a coating composition to be supplied in the form of at least one layer, and the flow surface.

The lip according to the invention comprises a front surface 10. The said front surface defines a surface which is either substantially vertical or positive, "substantially vertical" meaning a surface whose angle with respect to the vertical varies at most by ±10°. In this case, this surface may be actually vertical or, according to another advantageous embodiment, form an arc of a circle, the tangent to the said surface at the chamfer 12, which will be discussed in more detail below, itself being substantially vertical.

The embodiment according to which the front surface defines a positive surface is particularly suited to higher flow rates, namely flow rates greater than approximately 2.5 cm3/cm/s. In the latter case the angle formed by the front surface with respect to the vertical is preferably equal to or less than 45°. Good results have been obtained with an angle of approximately 15°. The lip also comprises a positive rear surface 11 forming an angle of no more than 90° with respect to the said front surface 10, the term positive having the same meaning as that given in the first part of the description. According to a preferred embodiment, the said rear surface defines an angle of no more than 45° with respect to the front surface of the lip and, preferably again, forms an angle $\phi$ of approximately 30° with respect to the said front surface.

The lower ends of the said front and rear faces of the lip are separated by a chamfer 12 whose width CW is, according to the present invention, as small as possible and preferably equal to or less than the thickness of the coating composition at the level of the front surface 10 of the lip. Advantageously the ratio between the thickness of the coating composition and the width of the chamfer is at least 5 and preferably at least 10.

The angle CA between the rear surface 11 of the lip and the chamfer 12 is not a critical parameter. Good results have been obtained with an angle CA varying between 60° and 120°.

In a preferred embodiment, the width of the chamfer is equal to or less than 0.5 mm and, preferably again, is equal to or less than 0.2 mm.

Such chamfers can be obtained by means of a conventional grinding machine.

By way of example, the coating device according to the present invention is used to coat a support with a photographic composition, the thickness of the photographic coating varies between 0.3 mm and 4 mm, the thickness e of the said coating depending on the viscosity $\mu$, the flow rate Q per unit of width, the angle $\delta$ of the front surface with respect to the horizontal, the density $\rho$ and the gravity g. All these parameters are connected by the following equation:

$$e = \left( \frac{3 \cdot Q \cdot \mu}{\rho \cdot g \cdot \sin\delta} \right)^{1/3}$$

For this specific use, the viscosity of the photographic coating composition is at least 0.03 P and preferably at least 0.2 P; the flow rate of the coating composition varies between 0.7 and 7 cm3/cm/s; the density $\rho$ is approximately 1 g/cm3.

For these values the width of the chamfer is preferably equal to or less than 0.5 mm and again preferably equal to or less than 0.2 mm, good results also having been obtained with a width of chamfer of approximately 0.1 mm. Table II below shows the curtain bendback BB and the wetting length WL obtained with different widths of chamfer and consequently with different values of the ratio e/CW (e being the thickness of the layer calculated with the formula set out above, CW being the width of the chamfer) as a function of the flow rate Q. In this example, the angle δ formed by the front surface 10 of the lip with respect to the vertical is zero; the viscosity is 0.03 P. The liquid is a mixture of water, gelatin and surfactant at 40° C. The surface tension is 26 mN/m.

| Flow rate: Q $cm^3/cm/s$ | Width of chamfer CW (mm) | e/CW | BB at 9 cm (mm) | $W_L$ (mm) |
|---|---|---|---|---|
| 2.6 | 2.5 | 0.2 | 26 | 1.9 |
| | 0.6 | 1 | 22 | 0.5 |
| | 0.2 | 3 | 14 | 0.4 |
| | 0.05 | 12 | 11 | 0.3 |
| 4.6 | 2.5 | 0.3 | 44 | 0 |
| | 0.6 | 1 | 17 | 0 |
| | 0.2 | 4 | 10 | 0 |
| | 0.05 | 15 | 8 | 0 |
| 6.4 | 2.5 | 0.3 | 35 | 0 |
| | 0.6 | 1 | 13 | 0 |
| | 0.2 | 4 | 8 | 0 |
| | 0.05 | 17 | 6 | 0 |

Table III below shows the curtain bendback BB and the wetting length WL obtained with different lengths of chamfer as a function of the flow rate Q. Once again in this example the angle δ formed by the front surface of the lip with respect to the vertical is zero; the viscosity is 0.35 P. The liquid is a mixture of water, gelatin and surfactant at 40° C. The surface tension is 26 mN/m.

| Flow rate: Q $cm^3/cm/s$ | Width of chamfer CW (mm) | e/CW | BB at 9 cm (mm) | $W_L$ (mm) |
|---|---|---|---|---|
| 2.6 | 2.5 | 0.6 | 0 | 0.7 |
| | 1.3 | 1.1 | 0 | 0.5 |
| | 0.6 | 2.3 | 0 | 0.4 |
| | 0.2 | 7 | 0 | 0.3 |
| | 0.1 | 14 | 0 | 0.1 |
| 4.6 | 2.5 | 0.7 | 18 | 1 |
| | 1.3 | 1.3 | 17 | 0.4 |
| | 0.6 | 2.8 | 13 | 0.2 |
| | 0.2 | 8.5 | 11 | 0.1 |
| | 0.1 | 17 | 9 | 0.1 |
| 6.4 | 2.5 | 0.8 | 28 | 0.5 |
| | 1.3 | 1.5 | 21 | 0.1 |
| | 0.6 | 3.2 | 14 | 0 |
| | 0.2 | 10 | 10 | 0 |
| | 0.1 | 19 | 9 | 0 |

The examples illustrated in these two tables show that the curtain bendback BB decreases considerably as the ratio e/CW increases, the improvement being all the more appreciable as the flow rate increases. The same applies to the wetting length WL. For a low viscosity (Table II), the lower the flow rate, relatively speaking, the greater the influence of the ratio e/CW on the wetting length. Table IV below shows the same type of data as those shown in Tables II and III for a viscosity of 0.03 P, the angle δ formed by the front surface with respect to the vertical being +15°. Once again it will be noted that the deviation of the curtain BB and the wetting length decrease considerably as the ratio e/CW increases. With the flow rates used in this example it will be noted that, for the same ratio e/CW, the curtain deviation BB is smaller than in the cases where the angle δ is zero (see Tables II and III). This can be explained by the fact that, in the case of a positive angle δ, the forces of inertia minimise the actual curtain bendback.

| Flow rate: Q $cm^3/cm/s$ | Width of chamfer CW (mm) | e/CW | BB at 9 cm (mm) | $W_L$ (mm) |
|---|---|---|---|---|
| 2.6 | 2.8 | 0.2 | 20 | 0.6 |
| | 1.3 | 0.5 | 20 | 0.6 |
| | 0.7 | 0.9 | 20 | 0.6 |
| | 0.2 | 3.1 | 13 | 0.4 |
| 4.6 | 2.8 | 0.3 | 22 | 0.5 |
| | 1.3 | 0.6 | 15 | 0.4 |
| | 0.7 | 1.1 | 8 | 0.2 |
| | 0.2 | 3.8 | 2 | 0.2 |
| 6.4 | 2.8 | 0.3 | 20 | 0.5 |
| | 1.3 | 0.7 | 8 | 0.1 |
| | 0.7 | 1.2 | 2 | 0.1 |
| | 0.2 | 4.2 | −3 | 0.1 |

We claim:

1. A curtain coating system wherein a coating composition is deposited on a moving support in the form of at least one layer having in combination:

a) a coating device comprising a feeding device (2,3) for supplying said coating composition to be deposited on a moving support, a flow surface (4) over which the coating composition flows by gravity at an outlet from said feeding device and a lip (5) from which the composition leaves the flow surface of the coating device along a front surface (10) thereof, said front surface having a bottom end and being either substantially vertical or positively sloped, said lip further comprising:

a) a positively sloped rear surface (11) having a bottom end and defining with said front surface (10) an angle θ of less than 90°; and b) a chamfer (12) between the bottom ends of said front and rear surfaces (10, 11) having a width, wherein a ratio between a thickness of the coating composition at the front surface (10) of the lip and the width of the chamfer (12) is at least one; and b) a moving support below and spaced from the lip such that the coating composition, upon leaving the lip, forms a free falling vertical curtain that impinges on one face of said moving support forming thereon a layer of said coating composition.

2. Coating device according to claim 1, wherein said front surface (10) forms an angle of no more than ±10° with respect to the vertical.

3. Coating device according to claim 1, wherein said front surface (10) forms, with respect to the vertical, a positive angle equal to or less than 45°.

4. Coating device according to claim 3, wherein said front surface (10) forms, with respect to the vertical, a positive angle of approximately 15°.

5. Coating device according to claim 1, in which said ratio between the thickness of the coating composition and the width of the chamfer (12) is at least 5.

6. Coating device according to claim 5, in which said ratio between the thickness of the coating composition and the width of the chamfer (12) is at least 10.

7. Coating device according to claim 1, in which the width of the chamfer (12) is equal to or less than 0.2 mm.

8. Device according to claim 1, in which the rear surface (11) defines, with respect to the front surface (10) of said lip, an angle of no more than 45°.

9. Coating device according to claim 1, in which the rear surface (11) defines, with respect to the front surface (10) of the lip, an angle of approximately 30°.

10. Coating device according to claim 1, in which said rear surface (11) defines, with respect to the chamfer (12), an angle of between 60° and 120°.

11. Coating device according to claim 1, wherein said coating composition is a photographic composition.

12. Coating device according to claim 11, wherein the flow rate of said coating composition is in a range of 0.7 to 7 cm3/cm/s.

13. Device according to claim 12, wherein the viscosity of said coating composition is at least approximately 0.03 P.

14. Device according to claim 13, wherein the viscosity of said coating composition is at least 0.2 P.

15. Device according to claim 14, wherein the flow rate of the coating composition is greater than 2.5 cm3/cm/s.

* * * * *